United States Patent [19]

Rockett

[11] Patent Number: 4,769,542

[45] Date of Patent: Sep. 6, 1988

[54] CHARGED PARTICLE ENERGY ANALYZER

[75] Inventor: Peter Rockett, Abingdon, England

[73] Assignee: VG Instruments Group Limited, Crawley, England

[21] Appl. No.: 928,038

[22] Filed: Nov. 7, 1986

[30] Foreign Application Priority Data

Nov. 7, 1985 [GB] United Kingdom ..... 8527438

[51] Int. Cl.[4] ..... H01J 49/48

[52] U.S. Cl. ..... 250/305; 250/309; 250/396 R; 250/292

[58] Field of Search ..... 250/305, 309, 396 R, 250/292

[56] References Cited

U.S. PATENT DOCUMENTS 3,935,453 1/1976 Liebl ..... 250/292

OTHER PUBLICATIONS

Satake et al., Japanese Journal of Applied Physics, vol. 1, No. 7, Jul. 1976, pp. 1359–1366.

Schubert et al., Review of Scientific Instruments, vol. 44, No. 4, Apr. 1973, pp. 487–491.

Sar-el, Review of Scientific Instruments, vol. 35, No. 9, Sep. 1967, pp. 1210–1216.

*Primary Examiner*—Craig E. Church
*Assistant Examiner*—Jack I. Berman
*Attorney, Agent, or Firm*—Bacon & Thomas

[57] ABSTRACT

The invention provides a charged-particle energy analyzer of the cylindrical mirror type (2,9,10) which incorporates beam shaping means (5,6) at one, or preferably both, ends. The beam shaping means to convert a substantially parallel beam of charged particles to an annular beam which diverges at the optimum entrance angle of the CMA, and v.v. They enable the CMA to operate efficiently with parallel input and output beams of circular cross section, and allow it to be efficiently combined with a mass analyzer, especially a quadrupole mass analyzer (31,32) to provide a compact energy-filtered mass spectrometer particularly suitable for secondary ion mass spectrometry.

19 Claims, 2 Drawing Sheets

CHARGED PARTICLE ENERGY ANALYZER

This invention relates to the field of electron or ion energy analysis, and in particular to the type of energy analyser known as a cylindrical mirror analyser (CMA).

Various types of charged particle analysers involving the passage of a beam of electrons or ions through an electrostatic field are known in the art. The type of fields required are well understood and their behaviour can be predicted with considerable precision. Johnson, L. P, Morrison, J. D, and Wahrhaftig, A. L. (Int. J. Mass Spectrom. and Ion Phys., 1978, vol. 26 p1) have reviewed a variety of the types of analysers in common use and describe the principle of the cylindrical mirror energy analyser in detail. Sar-el, M. Z (Rev. Sci. Instr. 1967, vol. 38 p 1210) gives a theoretical treatment of a CMA.

In its simplest form, the CMA comprises two coaxially disposed cylindrical electrodes with a suitable potential difference maintained between them. Charged particles from a source located on the common axis of the electrodes pass through a circumferential slit in the central electrode into the electrostatic field between the electrodes. They then follow curved trajectories which are similar to that of a projectile entering the earth's gravitational field along a direction inclined to the surface. The charged particles which have incident energies lying within the passband of the CMA leave the analyser through a second circumferential slit in the central electrode and converge at a focal point on the axis. The analyser can have both first and second order focusing characteristics providing it is designed in accordance with the principles explained by Sar-el, et. al. (ibid).

In order to obtain second order focusing, however, it is necessary that the charged particles enter and leave the analyser at angles of 42.3°, in other words, on the surface of a cone of 42.3° semiangle which additionally has its apex on the axis of the CMA inside the inner electrode some distance from its end and converges axially outwardly. This property clearly makes the CMA difficult to use in practice, although its high performance for a small physical size and its ease of manufacture recommend it in other respects.

It is an object of the present invention to provide a cylindrical mirror charged particle energy analyser which is capable of efficiently analysing a substantially parallel beam of charged particles, typically of circular cross section, and which is additionally or alternatively capable of producing such a beam of energy analysed particles.

An important potential use of a CMA is in conjunction with a quadrupole mass analyser. Such mass analysers require the energy of the charged particles to be mass analysed to lie within a certain limited range of energies, typically between 0.5 and 10 eV. Charged particles entering the spectrometer with higher energies pass through it so quickly that they do not undergo sufficient oscillations in the RF field for complete mass selection to take place and consequently some ions having energies greater than a certain value will strike the detector, increasing the background signal. In an application such as secondary ion mass spectrometry (SIMS), the secondary ions produced have a range of energies much greater than this, so that the sensitivity of a quadrupole analyser used to analyse the secondary ions is seriously limited. Consequently it is conventional in such applications to provide an energy selector in front of the quadrupole to pass only those ions having energies suitable for mass analysis by the quadrupole. The CMA is a useful type of energy analyser for the purpose, providing that the above mentioned problems can be overcome. A typical quadrupole analyser requires an input beam which is not diverging at more than approximately ±5° from the axis of the quadrupole and it is therefore necessary to provide some means of converting the rapidly converging annular beam from the CMA into a substantially parallel beam of circular cross section suitable for the quadrupole in order to achieve good sensitivity. A number of methods for interfacing a CMA with a quadrupole mas analyser are known. Johnson et.al. (ibid) used a series of tubular electrostatic lenses which penetrate inside the central electrode of the CMA, whilst Satake, Narusawa, et.al, (Japan. J. Appl. Phys, 1976, vol. 15, p 1359–1366) used a relatively conventional arraY of electrostatic lens elements in conjunction with a specially designed CMA with a gridded central electrode. This CMA operates with an incident angle much less than 42° and has its focal points outside the electrodes, and is therefore presumably not second order focusing. Liebl (U.S. Pat. No. 3,935,453) has adopted a rather different solution to the problem by splitting the CMA into two halves along a plane perpendicuIar to the axis, and interposing a plurality (12) of quadrupole analysers between the two halves. Schubert and Tracy (Rev. Sci. Instr. 1973, vol. 44 p 487) suggest the simple expedient of inclining the axis of the quadrupole and the CMA at approximately 42°.

All these prior art methods suffer from one or more defects, however. It is a difficult task to design an electrostatic lens system which meets the requirements, as exemplified by the complex and critical arrangement proposed by Johnson, et.al, whilst the performance of the CMA used by Satake, et.al, is presumably compromised bY the lack of second order focusing. The use of 12 quadrupole analysers suggested by Liebl is clearly an expensive solution, and the simple method proposed by Schubert and Tracy is obviously inefficient because only a segment of the rotationally sYmmetric output beam of the CMA can be admitted into the quadrupole.

It is a further object of the invention, therefore, to provide a cylindrical mirror analyser and mass analyser combination, which is simple to construct and which provides efficient transfer of the charged particles leaving the CMA into the mass analyser.

In accordance with these objectives, there is provided a charged-particle energy analyser of the cylindrical mirror type comprising cylindrical central and surrounding electrodes coaxially disposed about an axis, and, disposed at least at one end of said electrodes, beam shaping means adapted to produce an electrostatic field which is rotationally symmetrical about said axis, said electrostatic field being characterized by the presence in it of at least one equipotential surface which:

(a) converges towards a point on said axis remote from said central electrode, and (b) extends to the region of the exterior surface of said central electrode to make an acute angle with a coaxial projection of said exterior surface which extends in a direction away from said electrode.

In this way a substantially parallel beam of uniform cross section can be efficiently formed into a beam of annular cross section which diverges at an angle approximately equal to the acceptance angle of the CMA, thereby providing efficient transfer of the parallel beam into the CMA. More significantly, a similar arrangement at the exit end of the CMA can be used to convert the converging annular beam emerging from its exit aperture into a substantially parallel beam of circular cross section aligned with the axis, thereby facilitating the combination with a quadrupole mass spectrometer. Additional conventional electrostatic lenses disposed adjacent to the beam shaping means on the side remote from the analyser may also be provided, for example to bring the beam to a focus at a desired location.

The beam shaping means may conveniently comprise:

(a) an inner electrode whose surface is rotationally symmetrical about the axis of the electrodes comprising the cYlindrical mirror analyser, converges to a point on that axis in a direction away from the electrodes, and intersects at an acute angle the projection in that direction of the exterior surface of the central electrode of the CMA; and (b) an outer electrode spaced apart from said inner electrode and having a complementary shape thereto.

Preferably the acute angle is selected to be equal to the optimum entrance angle (or exit angle) of the CMA, usually substantially 42°. It will be appreciated that the gap between the inner and outer electrodes will be of annular form and because the electrodes are of complementary shape the gap will be of substantially constant width at all points along the CMA axis. The electrostatic field required by the invention is generated by applying a suitable electrical potential between the inner and outer electrodes. Preferably the inner electrode is maintained at the same electrical potential as the central electrode of the cylindrical mirror analyser, and may conveniently be formed as an extension of the central electrode.

The outer surface of the outer electrode is preferably cylindrical in form, and of diameter not exceeding that of the central electrode of the CMA. A guard electrode of hollow cylindrical form may then be provided around the outside of, and spaced apart from, the outer surface of the outer electrode of the beam shaping means where it protrudes within the surrounding electrode of the CMA. The guard electrode minimizes disturbance of the electrostatic field inside the CMA by the potential applied to the beam shaping means. The guard electrode is conveniently maintained at the same potential as the central electrode of the CMA.

The profile of the surface of the inner electrode of the beam shaping means is preferably that generated by the rotation of an arc of a circle about a tangent, with the tangent aligned with the axis of the CMA and the arc extending between the tangent and the point of intersection of the arc and an outwardly directed projection of the exterior surface of the center electrode of the CMA. If the arc angle is made equal to the required CMA entrance angle, the charged particles from a parallel beam will enter the CMA at substantially the correct angle. The profile of the inner-surface of the outer electrode is similar to that of the inner electrode, but of greater radius so that a constant width gap is left between it and the inner electrode.

Beam shaping means constructed in this way may be provided at either or both ends of the CMA. At the entrance, a charged particle travelling parallel to the CMA axis will be deflected through the space between the electrodes of the beam shaping means along a substantially circular trajectory and will enter the CMA at the optimum angle. Similarly, a charged particle leaving the CMA will follow a similar trajectory in the reverse direction in a beam shaping means at the exit of the CMA and will emerge travelling substantially parallel to the axis.

It is also within the scope of the invention, however, to use profiles of other shapes. For example, if the path length through the beam shaping means is short and it is not necessary to achieve the maximum possible performance from the analyser, it is possible to use a conical inner electrode with a semiangle equal to the desired angle of incidence into the CMA, and an outer electrode with a complementary conical hole, thereby simplifying manufacture.

In most cases, the entrance and exit angles of the CMA, and hence the angles at which the electrodes of the beam shaping means intersect the central electrode of the CMA, will be substantially 42°. This is the angle at which the CMA is second order focusing, as explained. Nevertheless, the invention can be used with other values of entrance and exit angles if desired.

Viewed from another aspect there is provided in combination a charged-particle analvser comprising a cylindrical mirror analyser having at its exit beam shaping means as defined above, and a mass analyser disposed to receive the energy analysed beam of charged particles leaving said cylindrical mirror analyser.

Preferably the mass analyser is a quadrupole mass analyser and the cylindrical mirror analyser and quadrupole mass analyser are disposed on a common axis.

A conventional electrostatic lens comprising a plurality of apertured plate-like electrodes disposed perpendicularly to said common axis may also be provided between the CMA and the quadrupole analyser. The potentials applied to this lens are adjusted to optimize transmission of the charged particles from the CMA into the mass analyser.

The combination of a CMA and a quadrupole mass analyser according to the invention has a number of important applications as explained previously, and provides a verY efficient and economical way of mass analysing a beam of charged particles in selected energy ranges.

Some examples of the invention will now be described in greater detail with reference to the following figures in which.

Figure 1:
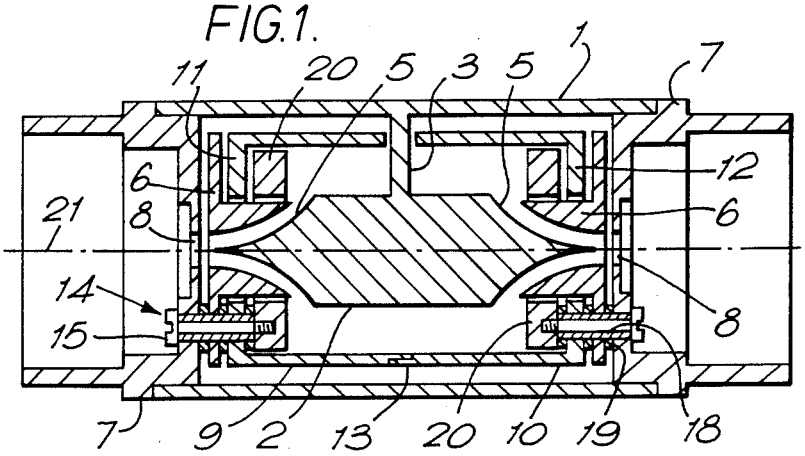
FIG. 1 is a sectional view of a cylindrical mirror charged-particle energy analyser constructed according to the invention.

Referring first to FIG. 1, a cylindrical mirror analyser (CMA) comprises a cylindrical central electrode 2 supported by three radial supporting rods 3, disposed at 120° to each other, from a cylindrical case 1. Rods 3 may conveniently be fitted into tapped holes in electrode 2 and secured by nuts on the outside of case 1, or alternatively, electrode 2, rods 3 and case 1 may be machined from a solid piece of material.

End pieces 7, containing apertures 8 through which the charged particles pass, are fitted in the ends of case 1. An outer surrounding electrode of the CMA comprises two cylinders 9 and 10 with end plates 11 and 12 which make an interlocking circumferential lap joint 13 when assembled. End plates 11 and 12 are supported by insulated mountings 14 and screws 15 from the end pieces 7. Insulated mountings 14 comprise ceramic tubes 18 fitted over screws 15 and ceramic spacers 19 fitted between end pieces 7 and the other components secured by screws 15. Preferably four insulated mountings 14, disposed at 90° to each other, are provided on each end piece 7.

Beam shaping means are provided at each end of the CMA and comprise inner and outer electrodes 5 and 6.

The inner electrodes 5 of the beam shaping means are extensions of the CMA central electrode 2 and are integral with it. In the embodiment shown, a circular profile is used, as seen in the section of FIG. 1, but other profiles are also suitable. Details of the formation of inner electrodes 5 are given below. Outer electrodes 6 of the beam shaping means, which have an exterior shape similar to a flanged cylinder, are secured by insulated mountings 14 from each end piece 7. The interior profile of the outer electrodes is complementary to that of inner electrodes 5.

Guard electrodes 20 are also supported on screws 15 and are of hollow cylindrical form. They are maintained at the same electrical potential as end piece 7, case 1 and central electrode 2 by means of screws 15. Electrical connection to the CMA surrounding electrode (g, 10) and the outer electrodes 6 of the beam shaping means are made by means of electrical conductors passing through holes (not shown) in case 1.

Figure 2:
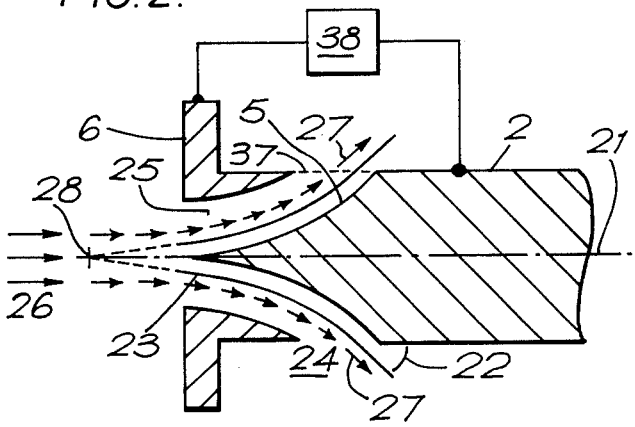
FIG. 2 is a sectional view of one embodiment of a beam shaping means suitable for use in the invention.

In FIG. 2, the electrodes 5 and 6 are shown in more detail. Electrode 5 is rotationally symmetrical about the axis 21 of the CMA and has a circular profile generated by rotating an arc of a circle about a tangent aligned with the axis 21. The radius of the circle is selected so that the angle 22 between an equipotential surface 23 and the projection of the surface of electrode 2 is 42.3°, at which angle the CMA is second order focusing. A suitable potential difference is applied between electrodes 5 and 6 by means of power supply 38 as shown. In the case of positive ions, electrode 6 will be negatively charged with respect to electrode 5. The value of this potential difference is selected to optimize the transmission of ions in the energy range selected by the CMA. Representing the potential on electrode 6 by $V_6$, the potential on the surrounding CMA electrodes 9 and 10 by $V_9$, and the potential on the inner electrodes 5 and 2 by $V_2$, then $V_9$ is adjusted to set the passband of the CMA for a given value of $V_2$, and $V_6$-$V_2$/$V_9$-$V_2$ is typically 0.3, when the CMA is set to pass ions of approximately 5 eV.

Annular gap 24 between electrodes 2 and 6 is equivalent to the entrance or exit slit of the CMA and is selected accordingly. The gap between electrodes 5 and 6 is preferably of constant width, as explained previously.

The potential difference between electrodes 5 and 6 results in an electrostatic field 25 which has at least one equipotential surface such as 23 (FIG. 2), the projection of which converges to a point 28 on axis 21.

Consequently, charged particles in a substantially parallel beam 26 will be deflected along trajectories indicated by the arrows 27 and will emerge through gap 24 at the desired angle 22 to a projection 37 of the exterior surface of electrode 2 towards point 28 (usually 42.3°). Similarly, in the case of a beam shaping means situated at the exit of the CMA, charged particles leaving at the optimum angle will follow arrows 27 in the reverse direction and emerge through aperture 8 approximately parallel to axis 21.

It will be appreciated that the operation of a beam shaping means constructed in this way will be to some extent dependent on the energy of the incident charged particles. However, as the length of the beam shaping means is short in comparison with the length of the CMA itself, the beam shaping means will have a much broader passband than the CMA and its effect can usually be neglected. Nevertheless, the energy dependence of the operation of the beam shaping means requires the voltage of power supply 38 to be varied in step with the voltage applied to the CMA as mentioned previously.

Figure 3:
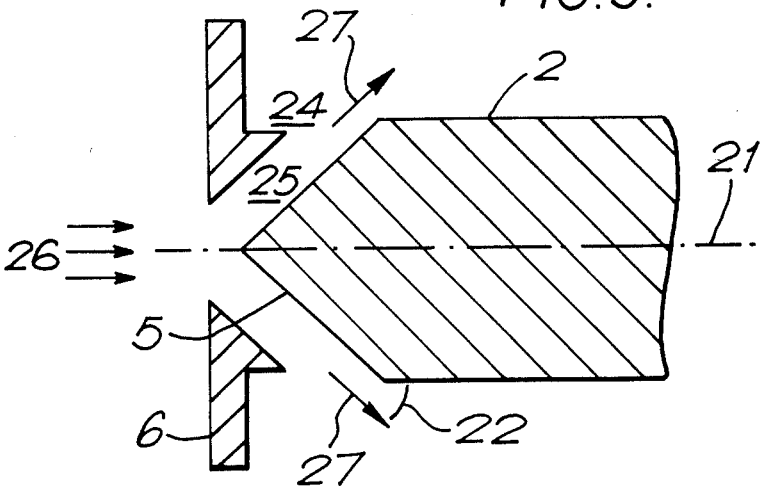
FIG. 3 is a sectional view of another embodiment of beam shaping means suitable for use in the invention.

FIG. 3 shows another form of beam shaping means suitable for use in the invention. Inner electrode 5 is again an integral extension of the CMA central electrode 2 but has a simple straight profile in place of the circular profile shown in FIG. 2, so as to be conical. Outer electrode 6 has a hollow conical form complementary to that of inner electrdode 5. The FIG. embodiment functions in a similar manner to the FIG. 2 embodiment but because the projections of the equipotential surfaces intersect axis 21 at a steeper angle than in the FIG. 2 embodiment, the transmission efficiency tends to be lower. The FIG. 3 embodiment is however very simple to manufacture and has adequate performance for many purposes.

Figure 4:
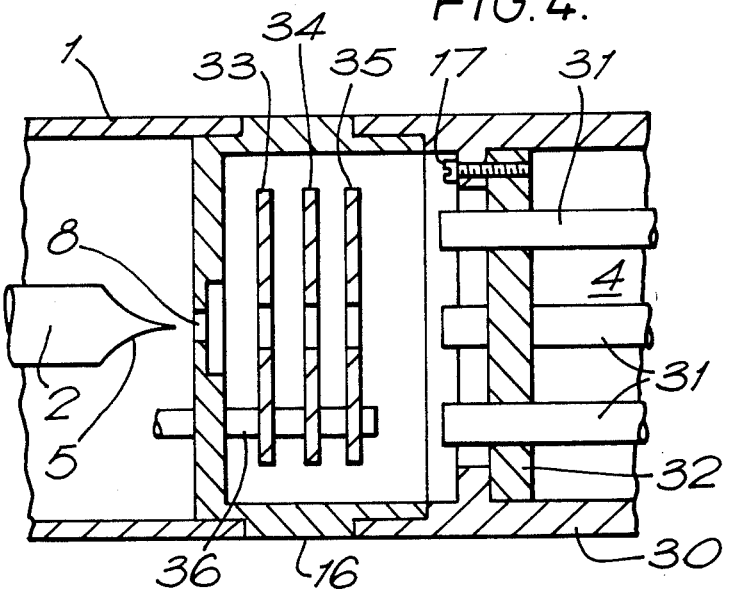
FIG. 4 is a sectional view showing the combination of the analyser with a quadrupole mass analyser in accordance with the invention.

FIG. 4 shows how a cylindrical mirror analyser with beam shaping means at its exit can be combined with a mass analyser. End piece 7 of a CMA constructed according to the invention is shaped slightly differently and serves as a mounting adaptor 16. A cylindrical support tube 30 is attached to the other end of adaptor 16 as shown. A quadrupole mass analyser 4 comprising four rods 31 and a support insulator 32 is secured inside tube 30 by screws 17. In order to maximize transmission of charged particles from the CMA to the quadrupole spectrometer a conventional three element electrostatic lens comprising apertured plates 33, 34 and 35 mounted on three insulated mountings 36 is provided inside adaptor 16. Mountings 36 are similar to mountings 14 in the CMA, and for convenience may be an extension of them, so that ceramic tubes 18 and screws 15 extend through adaptor 16 and secure both the CMA components and the plates 33, 34 and 35. Plates 33 and 35 are in general earthed, as in the case of a conventional lens, and plate 34 is maintained at an electrical potential selected by experiment to optimize transmission of the charged particles into the quadrupole.

It will be appreciated that although desirable, the use of the three element lens is not essential, and in many cases adequate transmission efficiency can be achieved simply by mounting the quadrupole analyser with its entrance close to aperture 8 in mounting adaptor 16.

The CMA/quadrupole mass analyser combination of the invention can be used in two ways, dependent on whether maximum sensitivity or maximum energy resolution is required. If maximum sensitivity is desirable, the central electrode 2 of the CMA is held at earth potential and the energy range of the charged particles passing through the CMA is selected by varying the potential on the surrounding electrode 9, 10. In order that the charged particles enter the quadrupole mass analyser 4 with the optimum energy (typically 5 eV), the "pole bias" of the quadrupole is selected to be approximately 5 V lower than the energy of the particles passing through the CMA. The potentials of electrodes 6, and of electrode 34 if provided, are adjusted to optimize transmission of the particles, and will in general vary with the energy of the particles passing through the CMA.

In order to achieve maximum energy resolution, the charged particles entering the CMA may be pre-retarded to a low energy by raising the potential of the central electrode of the CMA to a value just below the energy to be selected. The "pole bias" of the analyser, and potentials on electrodes 6 and 34, are adjusted as in the previous case to optimize performance.

Power supplies for the various electrodes of the invention are conventional, and the design of suitable supplies wilI present no difficulty to those skilled in the art.

What is claimed is:

1. A charged-particle energy analyser of the cylindrical mirror type comprising cylindrical central and surrounding electrodes coaxially disposed about an axis, and, disposed at least at one end of said electrodes, beam shaping means for producing an electrostatic field which is rotationally symmetrical about said axis, said electrostatic field being characterized by the presence in it of at least one equipotential surface which:

(a) converges towards a point on said axis remote from said central electrode, and (b) extends to the region of the exterior surface of said central electrode to make an acute angle with a coaxial projection of said exterior surface which extends in a direction away from said electrode.

2. A charged-particle energy analyser according to claim 1 in which said beam shaping means comprises:

(a) an inner electrode whose surface is rotationally symmetrical about said axis, converges to a point on said axis in a direction away from said central electrode, and intersects said projection at an acute angle, and (b) an outer electrode spaced apart from said inner electrode and having a complementary shape thereto.

3. A charged-particle energy analyser according to claim 2 in which the profile of said inner electrode is substantially that generated by rotation of an arc of a circle about a tangent aligned with said axis, said arc extending substantially from said tangent to the region of the exterior surface of said central electrode.

4. A charged-particle energy analyser according to claim 2 in which said inner electrode is conical and said outer electrode is of hollow conical form.

5. A charged-particle energy analyser according to claim 2 in which said inner electrode is electrically connected to said central electrode and the potential applied to said outer electrode optimized transmission of said charged particles within a selected energy pass band of the cylindrical-mirror energy analyser comprised by said central and surrounding electrodes.

6. A charged-particle energy analyser according to claim 1 in which said acute angle is substantially equal to the angle at which the cylindrical-mirror energy analyser comprised by said central and surrounding electrodes produces second order focusing.

7. A charged-particle energy analyser according to claim 2 in which said acute angle between said inner electrode and said projection is substantially equal to the angle at which the cylindrical-mirror energy analyser comprised by said central and surrounding electrodes produces second order focusing.

8. A charged-particle energy analyser according to claim in which said acute angle is substantially 42°.

9. A charged-particle energy analyser according to claim 2 in which said acute angle between said inner electrode and said projection is substantially 42°.

10. A charged-particle energy analyser according to claim 2 in which the exterior of said outer electrode is cylindrical and a guard electrode of hollow cylindrical form is disposed around it and within said surrounding electrode, and said guard electrode is electrically connected to said central electrode.

11. A charged-particle analyser comprising in combination a charged-particle energy analyser of the cylindrical mirror type comprising cylindrical central and surrounding electrodes disposed about an axis, a mass analyser, and beam shaping means for producing an electrostatic field which is rotationally symmetrical about said axis, said electrostatic field being characterized by the presence in it of at least one equipotential surface which:

(a) converges towards a point on said axis in a direction away from said central electrode; and (b) extends to the region of the exterior surface of said central electrode to make an acute angle with a coaxial projection of said exterior surface which extends in a direction away from said electrode.

12. A charged-particle analyser according to claim 11 in which said mass analyser comprises a quadrupole mass analyser disposed on a common axis with said energy analyser.

13. A charged-particle analyser according to claim 11 in which said beam shaping means comprises:

(a) an inner electrode which is rotationally symmetrical about said axis, converges to a point on said axis in a direction away form said central electrode, and intersects said projection at an acute angle, and (b) an outer electrode spaced apart form said inner electrode and having a complementary shape thereto.

14. A charged-particle analyser according to claim 13 in which said mass analyser comprises a quadrupole mass analyser disposed on a common axis with said energy analyser.

15. A charged-particle analyser according to claim 14 in which the profile of said inner electrode is that generated by rotation of the arc of a circle about a tangent aligned with said axis, said arc extending substantially from said tangent to the region of the exterior surface of said central electrode.

16. A charged-particle analyser according to claim 14 in which said inner electrode is conical and said outer electrode is of hollow conical form.

17. A charged-particle analyser according to claim 14 in which said inner electrode is electrically connected to said central electrode and the potential applied to said outer electrode optimizes transmission of said charged particles within a selected energy passband of the energy analyser, and in which said acute angle is substantially equal to the angle at which said energy analyser produces second order focusing.

18. A charged-particle analyser according to claim 17 in which said acute angle between said inner electrode and said projection is substantially 42°.

19. A charged-particle analyser according to claim 13 in which the exterior of said outer electrode is cylindrical and a guard electrode of hollow cylindrical form is disposed around it and within said surrounding electrode, and said guard electrode is electrically connected to said central electrode.

* * * * *